US010876346B2

(12) United States Patent
Hucker et al.

(10) Patent No.: US 10,876,346 B2
(45) Date of Patent: Dec. 29, 2020

(54) BRAKING DEVICE FOR A MOVABLE DOOR LEAF AND A DOOR CLOSER HAVING SUCH A BRAKING DEVICE

(71) Applicant: Geze Gmbh, Leonberg (DE)

(72) Inventors: Matthias Hucker, Marxzell (DE); Erhard Hahn, Leutenbach (DE)

(73) Assignee: Geze GmbH, Leonberg (DE)

( * ) Notice: Subject to any disclaimer, the term of this patent is extended or adjusted under 35 U.S.C. 154(b) by 110 days.

(21) Appl. No.: 16/241,268

(22) Filed: Jan. 7, 2019

(65) Prior Publication Data

US 2019/0242172 A1 Aug. 8, 2019

(30) Foreign Application Priority Data

Jan. 22, 2018 (DE) ..... 10 2018 200 946

(51) Int. Cl.
*E05F 5/04* (2006.01)
*E05F 15/63* (2015.01)

(52) U.S. Cl.
CPC ..... *E05F 15/63* (2015.01); *E05F 5/04* (2013.01); *E05F 2005/043* (2013.01); *E05Y 2201/21* (2013.01); *E05Y 2201/234* (2013.01); *E05Y 2201/266* (2013.01); *E05Y 2900/132* (2013.01)

(58) Field of Classification Search
CPC ..... E05B 2047/002; E05F 15/63; E05F 5/04; E05F 15/40; E05F 1/105; E05F 15/697; E05F 15/70; E05Y 2900/132; E05Y 2201/21; E05Y 2201/234; E05Y 2201/266; E05Y 2400/616; E05Y 2400/36
See application file for complete search history.

(56) References Cited

U.S. PATENT DOCUMENTS 6,175,204 B1 * 1/2001 Calamatas ..... H02P 7/04 318/375
8,169,169 B2 * 5/2012 Hass ..... E05F 15/63 318/286
10,208,520 B2 * 2/2019 Long ..... E05F 15/70
10,273,736 B2 * 4/2019 Hucker ..... E05F 15/603
(Continued)

FOREIGN PATENT DOCUMENTS

DE 102015200284 B3 10/2015

OTHER PUBLICATIONS

Combined Search and Examination Report issued in connection with UK Patent Application No. GB1820217.6 dated Jun. 5, 2019.
(Continued)

*Primary Examiner* — Thai T Dinh
(74) *Attorney, Agent, or Firm* — Steven M. Shape; Dennemeyer & Associates, LLC

(57) ABSTRACT

A braking device for a moveable door leaf includes an electrical brake motor operated as a generator. The motor shaft of which is rotatable by a movement of the door leaf and which can be controlled for regulating the closing speed of the door leaf by an electronic evaluation and control unit, which is at least partially provided with electrical energy by an electric motor operated as a generator and/or by an additional generator unit. The electronic evaluation and control unit is operable in a sleep mode and is cyclically displaceable into a waking state depending on the closing speed of the door leaf. A door closer with a mechanical energy storage and a braking device is also disclosed.

10 Claims, 1 Drawing Sheet

(56) References Cited

U.S. PATENT DOCUMENTS

| | | | | |
|---|---|---|---|---|
| 10,392,849 | B2 * | 8/2019 | Xiao | E05F 5/025 |
| 2002/0092237 | A1 * | 7/2002 | Hebda | E05B 17/0029 49/339 |
| 2003/0213092 | A1 * | 11/2003 | Fischbach | E05F 15/42 16/52 |
| 2004/0068935 | A1 * | 4/2004 | Ichikawa | E05B 85/01 49/25 |
| 2011/0252598 | A1 * | 10/2011 | Burris | E05F 3/227 16/62 |
| 2017/0362873 | A1 * | 12/2017 | Hucker | E05F 5/08 |

OTHER PUBLICATIONS

Office Action issued in connection with German Patent Application No. 102018200946.5 dated Jan. 27, 2020.

Intellectual Property Office, Combined Search and Examination Report, dated May 6, 2019, Intellectual Property Office, South Wales.

* cited by examiner

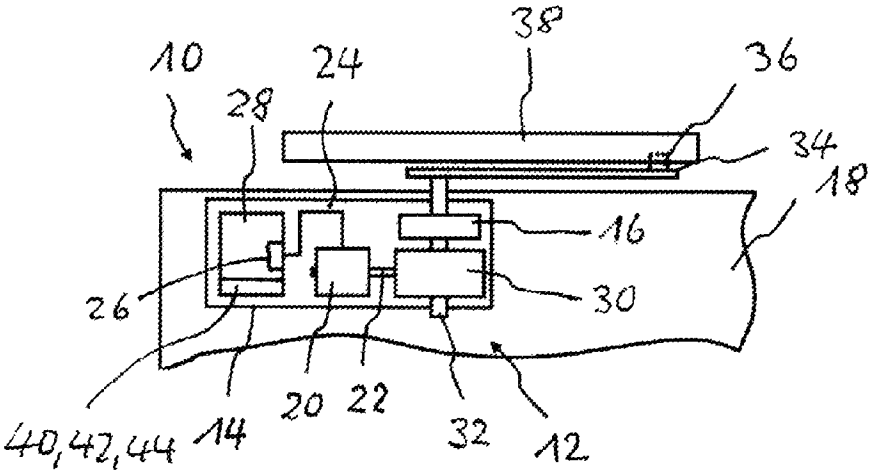
10
38
36
34
18
24
28
16
30
12
26
32
22
20
14
40,42,44

BRAKING DEVICE FOR A MOVABLE DOOR LEAF AND A DOOR CLOSER HAVING SUCH A BRAKING DEVICE

CROSS-REFERENCE TO RELATED APPLICATIONS

This application claims priority to German application 102018200946.5, filed Jan. 22, 2018, which is hereby incorporated by reference in its entirety.

BACKGROUND OF THE INVENTION

The invention relates to a braking device for a moveable door leaf having an electrical brake motor being operated as a generator, the motor shaft of which is rotatable by a movement of the door leaf and which can be controlled for regulating the closing speed of the door leaf by means of an electronic evaluation and control unit, which is at least partially providable with electrical energy by an electric motor being operated as a generator, particularly the brake motor and/or by means of an additional generator unit. Furthermore, the invention relates to a door closer having such a braking device.

A braking device of the above-mentioned type is known for example from DE10,2015/200,284 B3. The closing speed of the door leaf is thereby regulated by a pulse-width modulated short circuit of the motor terminals of the electric motor being operated as a generator. At the same time, generative potential energy of the mechanical accumulator of the door closer comprising a spring unit is converted into electrical energy to supply the electronic evaluation and control unit.

If the door leaf closes slowly, the electric motor being operated as a generator produces a relatively low electrical output. If on the other hand the door leaf closes quickly, the electric motor being operated as a generator produces a relatively high electrical output. As the electronics to regulate the closing speed of the door leaf are permanently active in the braking device known from DE10,2015/200,284 B3, and thus even at lower closing speeds must be supplied with electrical energy at least partially by the electric motor being operated as a generator, then the electric motor being operated as a generator must be designed to be relatively large, which is correspondingly costly.

With lower closing speeds of the door leaf, however, only a relatively small regulating frequency is now required. Thus, with a closing time of 90 seconds based on an opening angle of 90°, for example, it is sufficient if the electronic evaluation and control unit only corrects the speed every second, whereas with a relatively faster closing speed such as, for example, with a closing time of 3 seconds based on an opening angle of 90°, it must be regulated with a relatively high frequency, for example every 100 ms.

The object of the invention is to disclose a braking device and a door closer of the type mentioned at the outset, with which the electric motor being operated as a generator and being provided for the generative dampening of the movement of the door leaf can be designed to be as small as possible and correspondingly cost-effective.

SUMMARY OF THE INVENTION

The braking device according to the invention for a moveable door leaf comprises an electrical brake motor being operated as a generator, the motor shaft of which is rotatable by a movement of the door leaf and which can be controlled for regulating the closing speed of the door leaf by means of an electronic evaluation and control unit, which is at least partially providable with electrical energy by an electric motor being operated as a generator, particularly the brake motor and/or by means of an additional generator unit. The electronic evaluation and control unit is thus operable in a sleep mode and cyclically displaceable into a waking state depending on the closing speed of the door leaf, wherein the wake-up frequency, with which the electronic evaluation and control unit is cyclically awakened during a respective closing movement of the door leaf, is less at relatively lower closing speeds of the door leaf than at relatively higher closing speeds of the door leaf.

As the electronic evaluation and control unit is cyclically displaced into a waking state with a lesser wake-up frequency to regulate the closing speed of the door leaf based on the sleep mode at relatively lower closing speeds of the door leaf than at relatively higher closing speeds of the door leaf, it requires less electrical energy at relatively lesser closing speeds, at which the electric motor being operated as a generator supplies less output, such that the electric motor being operated as a generator can be designed to be correspondingly smaller and more cost-effective.

The closing speed of the door leaf is preferably adjustable by the electronic evaluation and control unit during a respective waking state of the electronic evaluation and control unit.

Advantageously, the motor terminals can be short-circuited for producing a respective braking force by means of a braking circuit.

In a further advantageous embodiment of the braking device according to the invention, a means connected with the electronic evaluation and control unit is provided to detect a closing and/or opening movement of the door leaf. Depending on whether a closing or opening movement of the door leaf is present, the wake-up frequency with which the electronic evaluation and control unit is awakened can be accordingly specified.

It is also advantageous if a means connected with the electronic evaluation and control unit is provided to determine the current closing speed of the leaf.

Alternatively or additionally, a means connected with the electronic evaluation and/or control unit can also be provided to determine the current opening angle of the door leaf.

According to an expedient, practical embodiment of the braking device according to the invention, the electronic evaluation and control unit terminates the dampening of the closing movement of the door leaf when the door leaf has achieved at least one settable final stop condition.

For example, a final stop speed and/or final stop position can be settable as a final stop condition.

The door closer according to the invention preferably comprises a mechanical energy storage, which is rechargeable through the manual opening of the door leaf and discharges with the closing of the door leaf, and a braking device wherein it is specified that the braking device is designed to correspond to the braking device according to the invention.

The mechanical energy storage advantageously comprises a spring unit which is tensioned by the manual opening of the door leaf and relaxes with the closing of the door leaf.

DESCRIPTION OF THE DRAWING

Preferred embodiments of the braking device according to the invention and the door closer according to the invention result from the dependent claims, the present description and the drawing.

FIG. 1 illustrates an embodiment of the braking device and door closer as disclosed.

DETAILED DESCRIPTION

The invention is explained in more detail below on the basis of an exemplary embodiment with reference to the drawing. In this, the single FIG. shows a schematic representation of an exemplary embodiment of a door closer 10 according to the invention with an exemplary embodiment of a braking device 12 according to the invention.

The door closer 10 comprises a housing 14, in which a mechanical energy storage 16 and the braking device 12 are arranged.

The mechanical energy storage 16 preferably comprises a spring unit and is charged with potential energy by manually opening the door leaf 18, which then closes the released door leaf 18 again.

The braking device 12 dampens the movement of the door leaf 18 and comprises an electric motor 20 being operated as a generator, the motor shaft 22 of said electric motor 20 being rotatable by a movement of the door leaf 18 and the motor terminals 24 of said electric motor 20 being arranged on a braking circuit 26, which can be controlled for regulating the closing speed of the door leaf 18 by means of an electronic evaluation and control unit 28. The electronic evaluation and control unit 28 being provided to regulate the closing speed of the door leaf 18 is thus at least partially providable with electrical energy by an electric motor 20 being operated as a generator and/or by means of an additional generator unit.

As can further be seen in the represented exemplary embodiment from FIG. 1, the door closer 10 with its housing 14 is, for example, fixedly mounted on the upper left edge region of the moveable door leaf 18. The motor shaft 22 of the electric motor 20 being operated as a generator is coupled via a gear 30 with an output shaft 32, said output shaft for example being coupled in the present case to a sliding arm 34. The sliding arm 34 features, at its free end, a sliding block 36 which is guided in a fixedly mounted sliding rail 38. The electric motor 20 being operated as a generator can for example be designed as an energised permanent magnet direct current motor.

During opening and closing of the door leaf 18, the motor shaft 22 of the electric motor 20 is rotated by means of the gear 30. The mechanical energy storage 16 comprising for example a spring unit can be thereby tensioned or relaxed, which however is not compulsory. With cantilevered systems, the mechanical energy storage 16 or the spring unit can, for example, be held in the tensioned position (door open), wherein the motor shaft 22 is however still rotated when the door leaf 18 is moved.

According to the invention, the electronic evaluation and control unit 28 is thus operable in a sleep mode and cyclically displaceable into a waking state depending on the closing speed of the door leaf 18, wherein the wake-up frequency with which the electronic evaluation and control unit 28 is cyclically awakened during a respective closing movement of the door leaf 18 is less at relatively lower closing speeds of the door leaf 18 than at relatively higher closing speeds of the door leaf 18.

The closing speed of the door leaf 18 is adjustable by the electronic evaluation and control unit 28 during a respective waking state of the electronic evaluation and control unit 28.

The motor terminals 24 of the electric motor 20 being operated as a generator can in particular be short-circuited for producing a respective braking force by means of a braking circuit 26.

With the electronic evaluation and control unit 28, means 40 for detected a closing and/or opening movement of the door leaf 18, means 42 for determining the current closing speed of the door leaf 18 and/or means 44 for determining the current opening angle of the door leaf 18 can be provided.

The electronic evaluation and control unit 28 can also be designed such that it terminates the dampening of the closing movement of the door leaf 18, when the door leaf 18 has achieved at least one settable final stop condition. For example, a final stop speed and/or a final stop position can be specified as the final stop condition.

LIST OF REFERENCE SYMBOLS

10 Door closer
12 Braking device
14 Housing
16 Mechanical energy storage
18 Door leaf
20 Electric motor
22 Motor shaft
24 Motor terminals
26 Braking circuit
28 Electronic evaluation and control unit
30 Gear
32 Output shaft
34 Sliding arm
36 Sliding block
38 Sliding rail
40 Means for detecting a closing and/or opening movement
42 Means for determining the closing and/or opening speed
44 Means for determining the opening angle

The invention claimed is:

1. A braking device (12) for a moveable door leaf (18), comprising:

an electrical brake motor (20) operated as a generator, the electrical brake motor (20) having a motor shaft (22) rotatable by a movement of the door leaf (18); and an electronic evaluation and control unit (28) operatively coupled to the motor shaft (22), the electronic evaluation and control unit (28) configured to control the motor shaft (22) for regulating a closing speed of the door leaf (18), the electronic evaluation and control unit (28) at least partially provided with electrical energy by the brake motor (20) or by an additional generator unit, the electronic evaluation and control unit (28) operable in a sleep mode and a waking state, and, wherein, upon detection of a closing movement of the door leaf, the electronic evaluation and control unit (28) is cyclically displaceable between the sleep mode and the waking state depending on a rotational speed of the motor shaft (22) corresponding to the closing speed of the door leaf (18), and the electronic evaluation and control unit (28) is cyclically displaced between the sleep mode and the waking state at a first frequency during a first closing movement of the door leaf (18) having a first closing speed and the electronic evaluation and control unit (28) is cyclically displaced between the sleep mode and the waking state at a second frequency greater than the first frequency during a second closing movement of the door leaf (18) having a second closing speed greater than the first closing speed.

2. The braking device according to claim 1, wherein the closing speed of the door leaf (18) is adjustable by the electronic evaluation and control unit (28) during the waking state of the electronic evaluation and control unit (28).

3. The braking device according to claim 1, further comprising a braking circuit (26) and motor terminals (24), wherein the motor terminals (24) are short-circuited for producing a respective braking force by the braking circuit (26).

4. The braking device according to claim 1, wherein a means (40) connected with the electronic evaluation and control unit (28) is configured to detect at least one of a closing movement or an opening movement of the door leaf (18).

5. The braking device according to claim 1, wherein a means (42) connected with the electronic evaluation and control unit (28) is configured to determine a current closing speed of the door leaf (18).

6. The braking device according to claim 1, wherein a means (44) connected with the electronic evaluation and control unit (28) is configured to determine a current opening angle of the door leaf (18).

7. The braking device according to claim 1, wherein the evaluation and control unit (28) is configured to stop a dampening of a closing movement of the door leaf (18) when the door leaf (18) has achieved at least one settable final stop condition.

8. The braking device according to claim 7, wherein at least one of a final stop speed or a final stop position is specified as the at least one settable final stop condition.

9. A door closer (10) comprising:

a mechanical energy storage (16), the mechanical energy storage (16) rechargeable (18) through a manual opening of the door leaf (18) and which discharges with a closing of the door leaf (18); and a braking device (12) according to claim 1.

10. The door closer according to claim 9, wherein the mechanical energy storage (16) comprises a spring unit, which is tensioned by the manual opening of the door leaf (18) and relaxes with the closing of the door leaf (18).

* * * * *